US007071960B2

(12) United States Patent
Toizumi et al.

(10) Patent No.: US 7,071,960 B2
(45) Date of Patent: Jul. 4, 2006

(54) IMAGE FORMING APPARATUS

(75) Inventors: Kiyoshi Toizumi, Nara (JP); Taisuke Kamimura, Kitakatsuragi-gun (JP); Toshimitsu Gotoh, Yamatokoriyama (JP); Tsutomu Yoshimoto, Yamatotakada (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 265 days.

(21) Appl. No.: 10/808,330

(22) Filed: Mar. 25, 2004

(65) Prior Publication Data

US 2004/0189781 A1 Sep. 30, 2004

(30) Foreign Application Priority Data

Mar. 28, 2003 (JP) ..... P2003-090529

(51) Int. Cl.

| | |
|---|---|
| ***G03G 15/24*** | (2006.01) |
| ***G03G 15/045*** | (2006.01) |
| ***G03G 15/047*** | (2006.01) |
| ***G03G 15/05*** | (2006.01) |

(52) U.S. Cl. ..... 347/130; 347/140; 399/136; 399/153

(58) Field of Classification Search ..... None
See application file for complete search history.

(56) References Cited

U.S. PATENT DOCUMENTS 5,565,963 A * 10/1996 Tsujita et al. ..... 399/48

FOREIGN PATENT DOCUMENTS

| | | |
|---|---|---|
| JP | H05-040381 A | 2/1993 |
| JP | H08-248648 A | 9/1996 |
| JP | 2001-109235 A | 4/2001 |

OTHER PUBLICATIONS

Kidaka, et al., Direct Formation of Electrostatic Latent Image by Means of Photoelectric Emission, Journal of the Institute of Electrostatics Japan, Jun. 1999, pp. 146-147, 23-3, the Institute of Electrostatics Japan, Tokyo Japan.

* cited by examiner

*Primary Examiner*—Huan Tran
(74) *Attorney, Agent, or Firm*—Birch, Stewart, Kolasch & Birch, LLP

(57) ABSTRACT

Electron generating devices and LED arrays are arranged in a surrounding area of a photosensitive drum. The electron generating devices are located downstream of a cleaner and upstream of a developing unit with respect to a turning direction of the photosensitive drum with a specific gap between the electron generating devices and a surface of the photosensitive drum. The LED arrays are disposed against outer ends of the electron generating devices opposite to inner ends thereof facing the photosensitive drum. When activated by a driving circuit according to image information, individual LED elements of the LED arrays emit light, causing the electron generating devices to emit electrons in a pattern corresponding to the image information. The electrons emitted from the electron generating devices produce more electrons due to an electron avalanche phenomenon before reaching the photosensitive drum, eventually forming an electrostatic latent image on the surface of the photosensitive drum.

20 Claims, 8 Drawing Sheets

IMAGE FORMING APPARATUS

CROSS REFERENCE

This nonprovisional application claims priority under 35 U.S.C. § 119(a) on Patent Application No. 2003-090529 filed in Japan on Mar. 28, 2003, the entire contents of which are hereby incorporated by reference.

BACKGROUND OF THE INVENTION

The present invention relates to an image forming apparatus, such as a copying machine, a printer or a facsimile machine, which performs electrophotographic image forming operation.

Many of currently used image forming apparatuses including copying machines, printers and facsimile machines employ an electrophotographic image forming process for reproducing image information on such recording media as sheets of paper. Generally, the electrophotographic image forming process includes a charging stage in which a surface of an image carrying member, or a photosensitive drum, is charged to a specific high surface potential, an exposure stage in which an electrostatic latent image is. formed on the surface of the image carrying member by exposing the surface to light controllably projected thereto based on image information to produce varying surface potentials, a development stage in which the latent image is converted into a visible toner image by supplying toner particles onto the surface of the image carrying member, an image transfer stage in which the toner image on the surface of the image carrying member is transferred onto a surface of a recording medium, and a fixing stage in which the transferred toner image is fused onto the surface of the recording medium.

Traditionally employed in the aforementioned charging stage of the electrophotographic image forming process has been a conventional charging method in which a high voltage is applied to a main charger disposed face to face with the surface of the image carrying member to produce a corona discharge. This conventional charging method poses a problem related to environmental degradation due to the influence of ozone produced as a byproduct of the corona discharge. In addition, there is a growing demand today for a reduction in power consumption. Under these circumstances, a contact charging method which uses a charging roller, a charging brush or the like has been proposed in recent years as disclosed in Japanese Laid-open Patent Publication No. 2001-109235, for instance.

In the exposure stage, a digital exposure method is often used today as a result of development of office automation equipment including computers instead of an analog exposure method in which an image carrying member is exposed to light projected to and reflected from an original placed on a platen glass and guided to the image carrying member through multiple mirrors and a through lens. In a digital exposure process, image information picked up by an image scanning section or transmitted from one of terminal devices through a network, to which the image forming apparatus is connected, is once stored in a control section of the image forming apparatus and subjected to image processing. The image carrying member is then exposed to light modulated by the processed image information in an exposure unit (e.g., a laser scan unit).

Japanese Laid-open Patent Publication Nos. H05-040381 and H08-248648 disclose another exposure method developed to cope with a demand for a image forming apparatus of reduced size. The exposure method disclosed in the Publications is a so-called backside exposure method in which charging, exposing and developing operations are simultaneously performed by use of a cylinder-shaped transparent photosensitive drum. In an image forming process adopting the backside exposure method, the photosensitive drum is exposed to light modulated by image information from inside its cylindrical structure to form an electrostatic latent image on the photosensitive drum, and the latent image is developed as electrically conductive toner particles are attracted to exposed surface areas of the photosensitive drum from its outside.

More specifically, an outer surface of the image carrying member is locally charged by static charges of electrically conductive toner at a first half portion of a developing nip area where the outer surface of the image carrying member moves along the electrically conductive toner with friction, whereas image writing light is projected onto an inner surface of the image carrying member to form an electrostatic latent image on the outer surface of the image carrying member so that the toner particles are attracted to the exposed surface areas (or the latent image) on the photosensitive drum at a second half portion of the developing nip area to form a visible toner image.

Another conventionally known image forming process is introduced in an article titled "Direct Formation of Electrostatic Latent Image by Means of Photoelectric Emission" published in Journal of Institute of Electrostatics Japan (IEJ) 1999 (Vol. 23 No. 3). This direct imaging process employs a xenon light source which projects light modulated by image information onto a photoelectric surface. When illuminated by the light, the photoelectric surface emits electrons toward a surface of an image carrying member to write the image information thereon.

The aforementioned conventional image forming processes have their inherent drawbacks, however. While the contact charging method serves to reduce the amount of ozone produced in the charging stage, there arises the need to rotate the charging roller or charging brush in a controlled fashion and it is not possible to sufficiently reduce a charging voltage compared to a case where a charger is used to charge the image carrying member. In addition, while the image carrying member continuously turns during the image forming process and the surface of the image carrying member repetitively undergoes the charging, exposure, development and transfer stages, the toner supplied to the surface of the image carrying member is not transferred in its entirety to the surface of the recording medium in the image transfer stage, but part of the toner that is left on the surface of the image carrying member and is attracted to the charging roller or the charging brush. Residual toner particles attracted to the charging roller or the charging brush become loose when a voltage is applied in a succeeding charging step and, as a consequence, the toner particles firmly adhere to the charging roller or the charging brush. This phenomenon could damage the surface of the image carrying member and cause eventual degradation of image quality.

In either of the aforementioned conventional analog and digital exposure methods, it is necessary to configure a light path including the focal length of an optical system for focusing image writing light on the surface of the image carrying member. For this reason, the optical system must have a high accuracy and the need for such a light path makes it difficult to achieve compact design of the image forming apparatus. Particularly in the digital exposure method employing a laser scan unit, it is necessary to rotate a polygon mirror for redirecting a laser beam at a high speed.

Thus, the digital exposure method is associated with such technical problems as difficulties in precisely controlling high-speed rotation of the polygon mirror and the need for a dustproof structure for preventing a whirl of dust which might be produced by air currents caused by the rotating polygon mirror. These problems could result in an inability to achieve compact design as well as degradation of image quality.

One problem of the aforementioned backside exposure method is a difficulty in choosing material of a transparent cylinder used as the image carrying member. Another problem of the backside exposure method is that considerably high accuracy is needed in installing a driving mechanism to ensure proper charging of the image carrying member, writing of the image information and development of the visible toner image, because the charging of the image carrying member, the writing of the image information and the development of the visible toner image are performed within a developing gap, which normally measures about 2 mm to 5 mm, where the image carrying member comes into contact with toner particles. Inadequate installation accuracy of the driving mechanism significantly affects the image quality. Since the outer surface of the image carrying member is charged by use of the electrically conductive toner in the backside exposure method, it is necessary to apply a relatively high voltage to the electrically conductive toner by means of a developing sleeve. Considerable variations occur in potential to which the electrically conductive toner is charged as a result of voltages applied thereto. The toner is apt to deteriorate quickly due to such variations in potential.

The aforementioned direct imaging approach introduced in the article in the IEJ Journal also has problems from a practical viewpoint. Specifically, the direct imaging approach is likely to increase the physical size of an image forming apparatus and pose a problem with respect to a method of converging light in a light source section. While the article discloses a flat-type plotter as a practical example of application of the direct imaging approach, the recording medium is limited in size by the size of a dielectric layer on which an electrostatic latent image is formed and, therefore, the approach of the article can not be applied to ordinary image forming apparatuses which can selectively form images on recording media having different sizes. In addition, the dielectric layer must be cleaned upon completing an image forming step for each single image before proceeding to a next step. For this reason, the image forming apparatus employing the direct imaging approach can form a limited number of images per unit time and is not quite suited to image forming operation in which a large number of images need to be processed.

SUMMARY OF THE INVENTION

It is a feature of the invention to provide an image forming apparatus capable of performing charging and exposing operations in a single step without sacrificing image forming performance or functions of the apparatus, yet allowing compact design, energy savings and an improvement in image quality of the apparatus as well as an extended operational life of an image carrying member.

According to one embodiment of the invention, an image forming apparatus includes an electron generating device which generates electrons when illuminated, the electron generating device being disposed face to face with a surface of an image carrying member across a specific gap between the electron generating device and the surface of the image carrying member, an LED array including as large a number of LED elements as necessary for achieving an intended resolution of image information from which an image is to be formed, the LED array being disposed face to face with the surface of the image carrying member with the electron generating device placed therebetween, and a driving circuit for activating the LED array according to the image information.

In this construction, the LED array emits light for illuminating the electron generating device with the intended resolution of the image information from which the image is to be formed and the electron generating device illuminated by the LED array generates electrons according to the image information. The electrons emitted from the electron generating device produce electron avalanches within the gap between the electron generating device and the surface of the image carrying member and create a patterned distribution of high and low surface potentials on the surface of the image carrying member corresponding to the image information. It is possible to form an electrostatic latent image (the patterned distribution of high and low surface potentials) on the surface of the image carrying member with high fidelity by supplying a driving signal corresponding to the image information to the LED array.

These and other features and advantages of the invention will become more apparent upon reading the following detailed description in conjunction with the accompanying drawings.

DETAILED DESCRIPTION OF THE INVENTION

Figure 1:
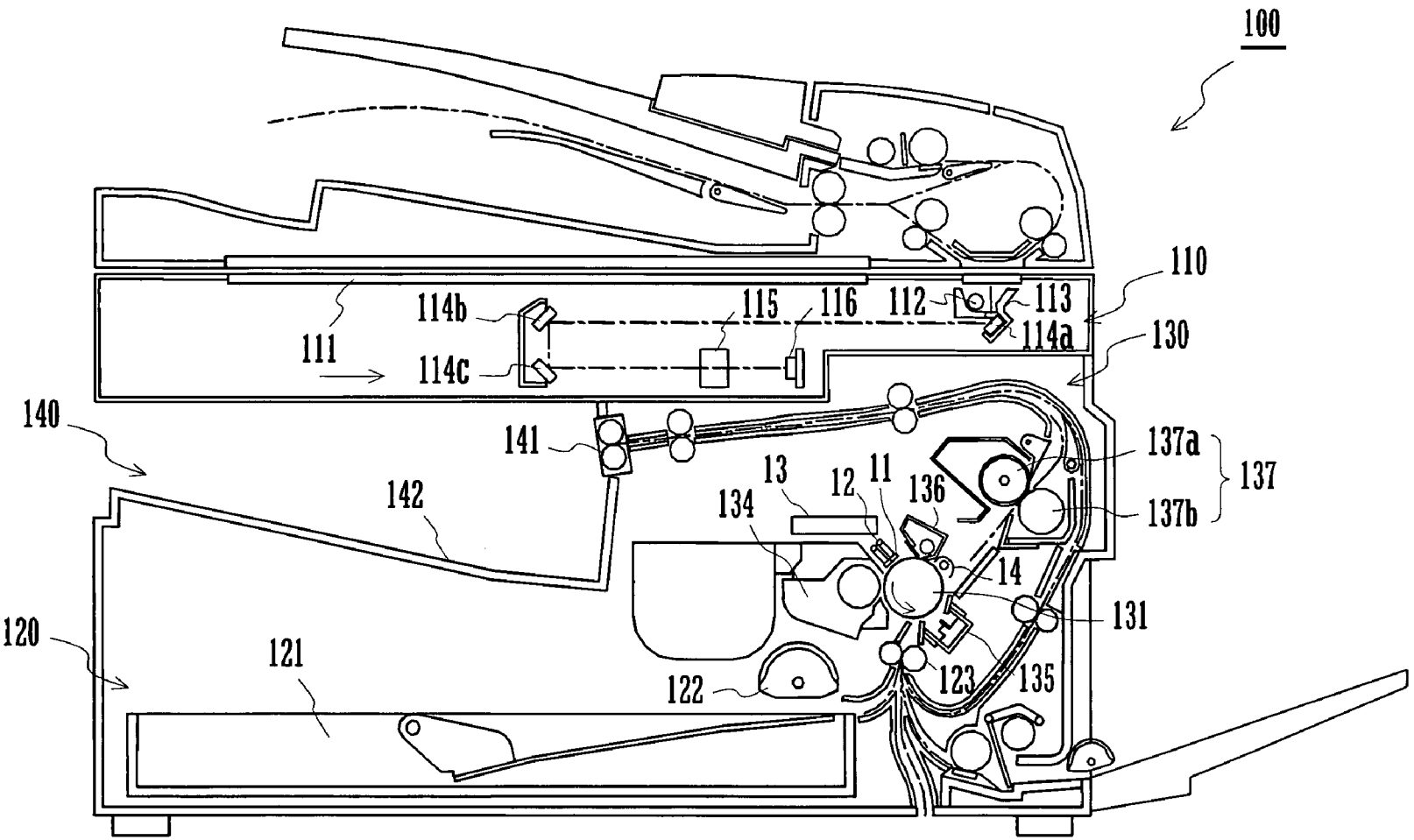
FIG. 1 is a diagram showing the construction of an image forming apparatus according to a preferred embodiment of the invention.

FIG. 1 is a diagram showing the construction of an image forming apparatus 100 according to a preferred embodiment of the present invention. The image forming apparatus 100 includes an image scanning section 110, a sheet feeding section 120, an image forming section 130 and a sheet delivery section 140. The image scanning section 110 is located above the sheet feeding section 120 while the sheet delivery section 140 is located in a space between the image scanning section 110 and the sheet feeding section 120.

A user loads sheets of paper into a paper cassette 121 provided in the sheet feeding section 120, places an original to be reproduced on a platen glass 111 of the image scanning section 110, and sets such image forming parameters as the number of copies and a printing scale factor through an operator panel (not shown). If the user presses a start key on the operator panel under this condition, the image forming apparatus 100 commences an image forming operation.

The image forming apparatus 100 activates a main motor (not shown) to turn individual driving gears almost instantly when the start key is pressed. At this point, a sheet feed roller 122 begins to rotate to feed a sheet from the paper cassette 121. The sheet fed from the paper cassette 121 reaches a pair of registration rollers 123.

When the sheet reaches the registration rollers 123 which are not rotating yet, the sheet stops at the registration rollers 123 with its leading edge forced against the registration rollers 123, whereby the feeding direction of the sheet is corrected to remove any oblique feed. Subsequently, the registration rollers 123 begin to rotate with specific timing to advance the sheet into the image forming section 130 in such a manner that the leading edge of the sheet aligns with a foremost end of an electrostatic latent image at a point where an image transfer unit 135 faces a photosensitive drum 131.

In the image scanning section 110, a copy lamp unit 113 moves in an arrow direction with a built-in copy lamp 112 lit. Light emitted from the copy lamp 112 illuminates the original placed on the platen glass 111. Reflected light is guided by mirrors 114*a*, 114*b* and 114*c* and focused by an optical lens 115 on a photosensitive surface of a charge-coupled device (CCD) 116, which converts incident light into electrical image information.

The image information thus obtained is subjected to a specific image processing operation performed by an image processing circuit of a control unit which is not illustrated and resultant image data is supplied to the image forming section 130. The image forming section 130 forms the aforementioned electrostatic latent image on an outer surface of the photosensitive drum 131, or an image carrying member which is a key element of the present invention, based on the input image data. The electrostatic latent image is converted into a visible toner image by applying toner particles supplied by a developing roller of a developing unit 134.

The image transfer unit 135 transfers the toner image formed on the surface of the photosensitive drum 131 onto the sheet (recording medium) and a cleaner 136 collects residual toner left on the surface of the photosensitive drum 131. Then, the sheet carrying the transferred toner image which is still loose is passed between an upper heat roller 137*a* and a lower heat roller 137*b* of a fuser unit 137, which applies heat and pressure to fuse and fix the toner image onto the sheet. Finally, the sheet carrying the securely fixed toner image is discharged onto a sheet delivery tray 142 in the sheet delivery section 140 by means of sheet transport rollers 138 and sheet output rollers 141.

The image forming apparatus 100 of the present embodiment performs charging and exposing operations in a single step. For this purpose, the image forming apparatus 100 is provided with electron generating devices 11 and light-emitting diode (LED) arrays 12 instead of the conventional provision of a charger, a laser scan unit, etc. While the image carrying member of this embodiment is the photosensitive drum 131 having a cylindrical shape, the invention is not limited to this structure but may employ a different form of image carrying member, such as a photosensitive belt.

The electron generating devices 11 and the LED arrays 12 are arranged in a surrounding area of the photosensitive drum 131. More particularly, the electron generating devices 11 are located downstream of the cleaner 136 and upstream of the developing unit 134 with respect to a turning direction of the photosensitive drum 131 shown by an arrow in FIG. 2 with a specific gap between the electron generating devices 11 and the outer surface of the photosensitive drum 131. The LED arrays 12 are disposed against outer end surfaces of the electron generating devices 11 opposite to inner end surfaces thereof facing the surface of the photosensitive drum 131.

When the electron generating device 11 is irradiated with light at a particular location on a rear surface, the electron generating device 11 emits electrons from a corresponding location on a front surface. A photochromic material or a photoelectric surface are usable candidates for constituting an electron generating device.

Figure 3:
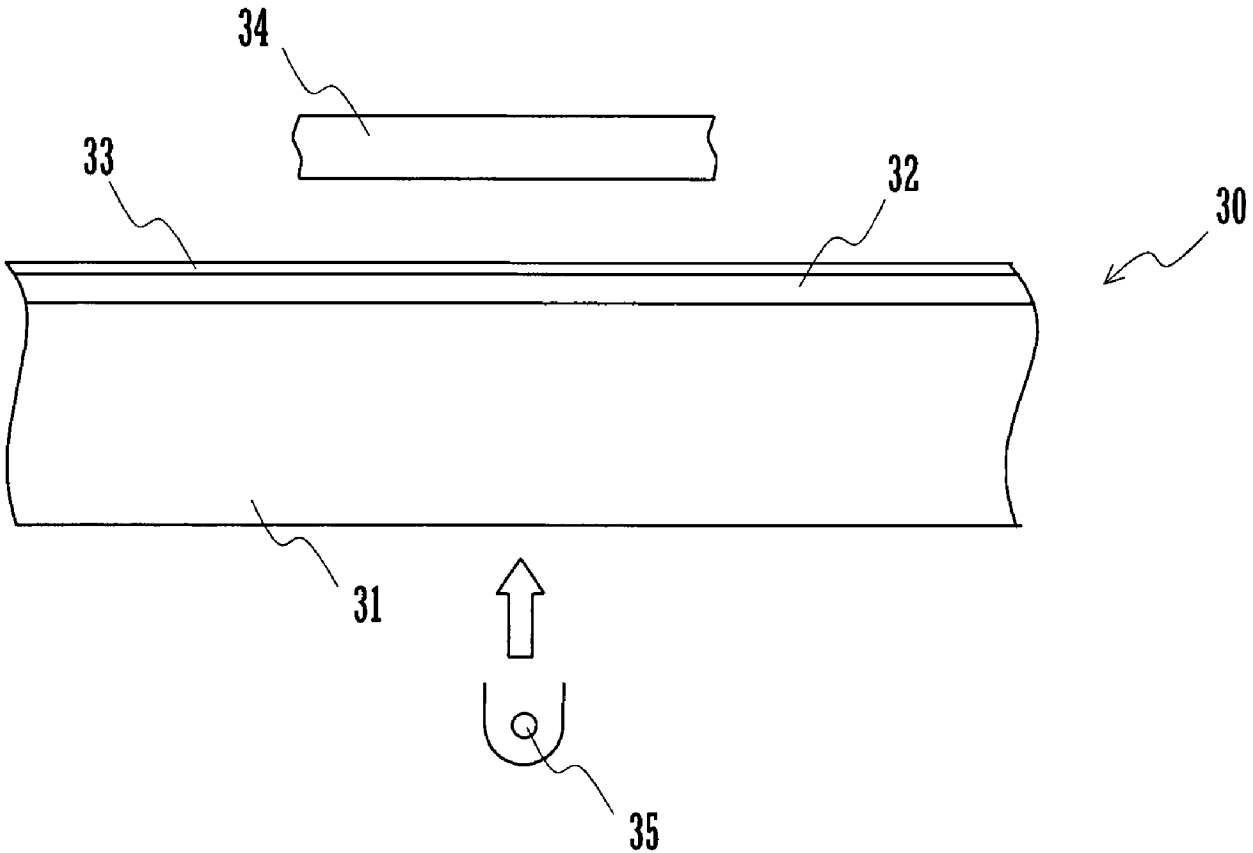
FIG. 3 is a diagram illustrating a method of experiments conducted for evaluating an electron generating device produced by using a photochromic material.

FIG. 3 is a diagram illustrating a method of experiments conducted for evaluating an electron generating device produced by using a photochromic material. For the purpose of the experiments, a simulated electron generating device 30 was produced by evaporating an indium tin oxide (ITO) layer 32 to a thickness of a few tens of nanometers and a semiconductor (i.e., gallium arsenide, or GaAs) layer 33 to a thickness of a few tens of nanometers in this order on a flat, transparent acrylic sheet 31 measuring 1 mm to 5 mm thick. Facing the side of the semiconductor layer 33 of this simulated electron generating device 30, a polycarbonate resin sheet 34 which was a 10 μm to 100 μm thick, electrically chargeable photosensitive surface material was placed as a substitute for the photosensitive drum 131 at a distance of approximately 150 μm from the semiconductor layer 33. Further, an ultraviolet light emitting device 35 was placed on the opposite side (rear side) of the electron generating device 30 as illustrated.

Using this arrangement, ultraviolet light having a wavelength of 350 nm emitted from the ultraviolet light emitting device 35 was projected to the electron generating device 30 from its rear side at an irradiating energy level of 0.1–10 $mW/cm^2$. As a consequence, a surface of the polycarbonate resin sheet 34 was charged to a potential range of −30 V to 150 V.

Figure 4:
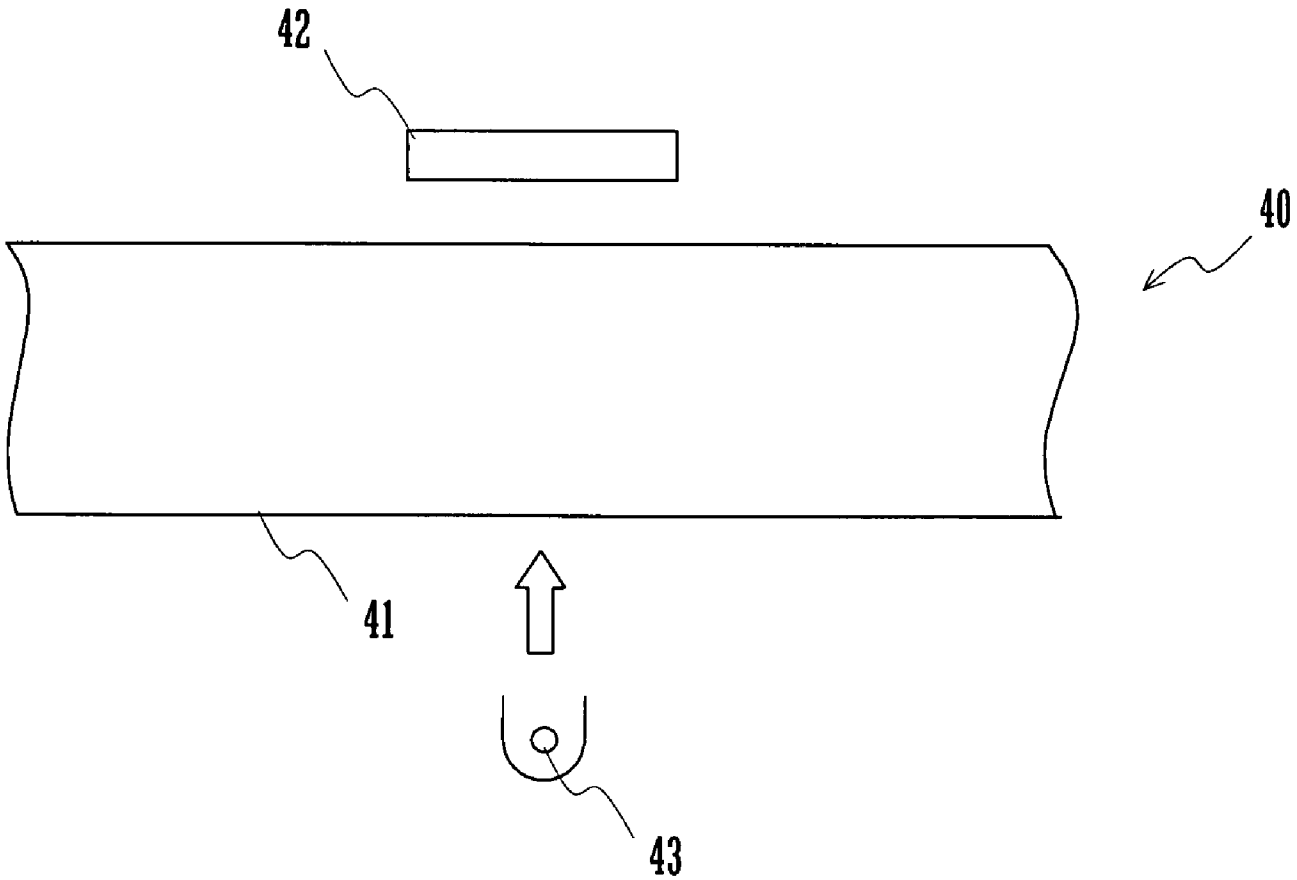
FIG. 4 is a diagram illustrating a method of experiments conducted for evaluating an electron generating device produced by using a photoelectric surface.

FIG. 4 is a diagram illustrating a method of experiments conducted for evaluating an electron generating device produced by using a photoelectric surface. An electron generating device 40 having a photoelectron emitting surface (cathodic surface) was produced by depositing aluminum on a surface of a flat silica glass sheet 41 and an anodic surface 42 formed by depositing ITO on a glass substrate was placed parallel to the electron generating device 40 at a distance of approximately 150 μm from a surface of the electron generating device 40.

The electron generating device 40 was biased with a negative voltage and the anodic surface 42 was grounded through an electrometer (manufactured by Advantest Corporation). With this arrangement, a current flowing between the anodic surface 42 and the ground was measured.

When the electron generating device 40 was exposed to ultraviolet light having a wavelength of 254 nm emitted from an ultraviolet light emitting device 43, the electron generating device 40 emitted electrons from the surface of its aluminum layer due to the photoelectric effect. In this arrangement, an electron avalanche phenomenon occurs between the aluminum layer and the anodic surface 42 when an intense electric field is applied therebetween. Electrons emitted from the electron generating device 40 due to the electron avalanche phenomenon breed, or produce, more electrons before reaching the anodic surface 42. The higher the electric field applied between the electron generating device 40 and the anodic surface 42, the more often the electrons emitted from the electron generating device 40 collide with air molecules, producing more electrons and, thus, increasing the amount of electric current flowing between the anodic surface 42 and the ground. This amount of electric current is proportional to the number of electrons emitted from the aluminum photoelectric surface. Therefore, the quantity of electrons emitted from the electron generating device 40 in an initial stage is important in knowing the performance of the cathodic surface of the electron generating device 40.

While varying conditions for depositing an aluminum layer on the electron generating device 40, the relationship between the aluminum depositing conditions and the quantity of electrons emitted from the electron generating device 40 was examined. For this purpose, −100 V was applied to the aluminum photoelectric surface of the electron generating device 40, ultraviolet light having the wavelength of 254 nm emitted from the ultraviolet light emitting device 43 was projected on the electron generating device 40, and a correlation between changes in the amount of electric current flowing through the anodic surface 42 in an initial stage and the aluminum depositing conditions was determined as shown in FIG. 5.

Figure 5:
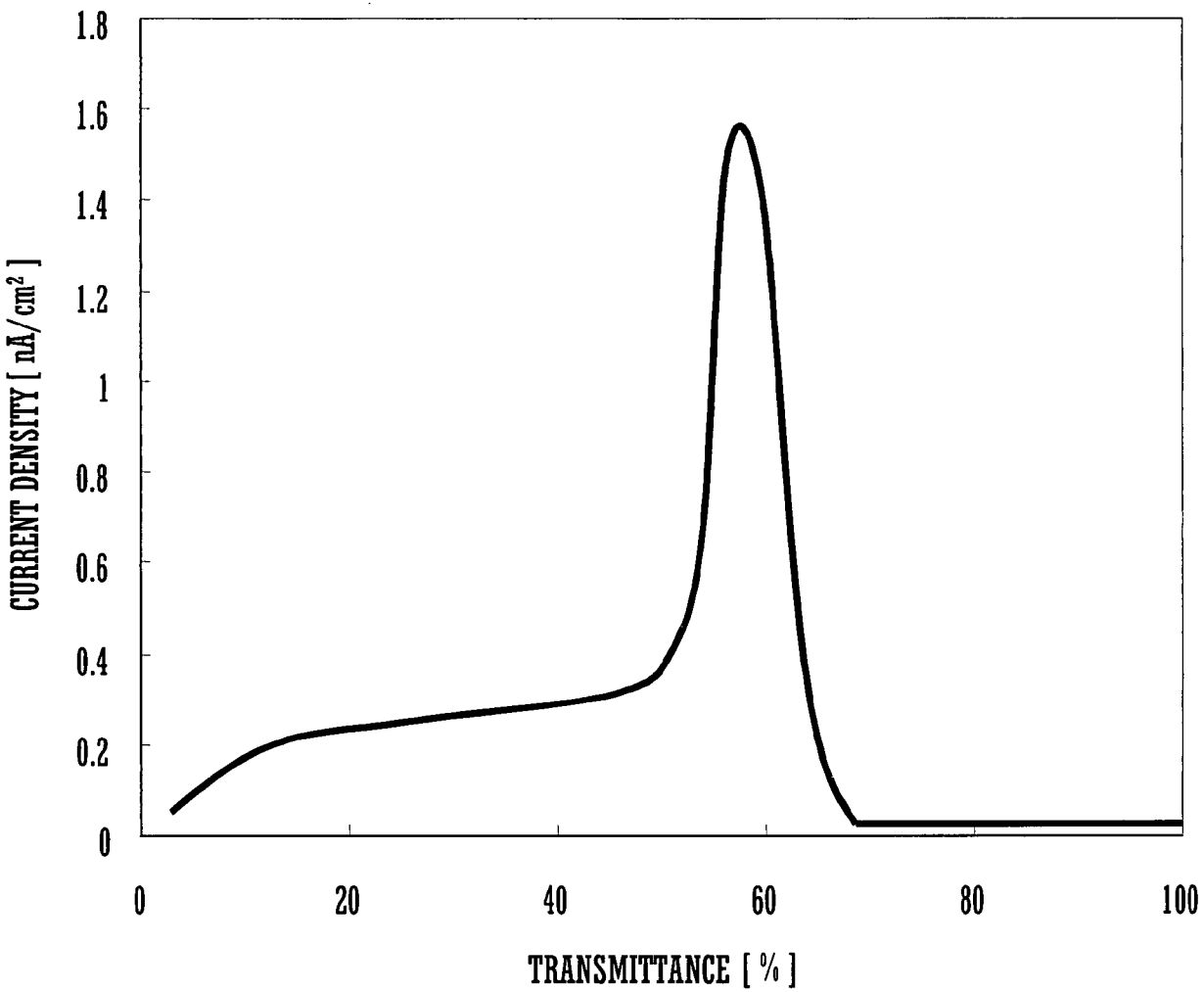
FIG. 5 is a diagram showing experimental results obtained by using the electron generating device having the photoelectric surface.

Referring to FIG. 5, experimental results indicate that greater currents flow between the anodic surface 42 and the ground when the aluminum photoelectric surface has a transmittance falling within a range of 50% to 70%. The experimental results also indicate that the aluminum photoelectric surface having the transmittance of 50% to 70% has a film thickness between about 10 nm to 50 nm and greater quantities of electrons are emitted when the film thickness of the aluminum photoelectric surface falls within this range.

When great quantities of aluminum evaporate forming an aluminum layer approximately 50 nm to 200 nm thick, the transmittance falls within a range of 0% to 50%. If the quantity of vapor-deposited aluminum is too large, light is blocked by the aluminum layer and will not reach the surface. Thus, the quantity of electrons emitted from the electron generating device 40 is supposed to decrease in a low transmittance range. As can be seen from the experimental results (FIG. 5), a current density of about 0.3 $nA/cm^2$ is obtained when the transmittance of the aluminum layer is 0% to 50%. This current density is approximately ⅕ of a maximum current density (1.5 $nA/cm^2$) obtained at a transmittance of 50% to 70%.

When the transmittance of the aluminum layer was equal to or higher than 70% (layer thickness 10 nm or less), the quantity of deposited aluminum was so small that the aluminum layer was formed in uneven patches located here and there on the silica glass sheet 41. Should this be the case, the aluminum layer could not supply adequate quantities of electrons and the current density was almost 0 $nA/cm^2$.

Overall, the experimental results have demonstrated that the electron generating device can be produced by using either the photochromic material or the photoelectric surface if appropriate layers are formed under appropriate depositing conditions. Thus, in the image forming apparatus 100 of the present embodiment of the invention, the electron generating devices 11 having a layer of a photochromic material or photoelectric surfaces are disposed at locations illuminated by the LED arrays 12 (light source). Controlled by a driving signal supplied from a driving circuit 13 with proper light source on/off timing according to the image information, the electron generating devices 11 produce electrons in a precisely controlled fashion to form an electrostatic latent image on the outer surface of the photosensitive drum 131.

Figure 2:
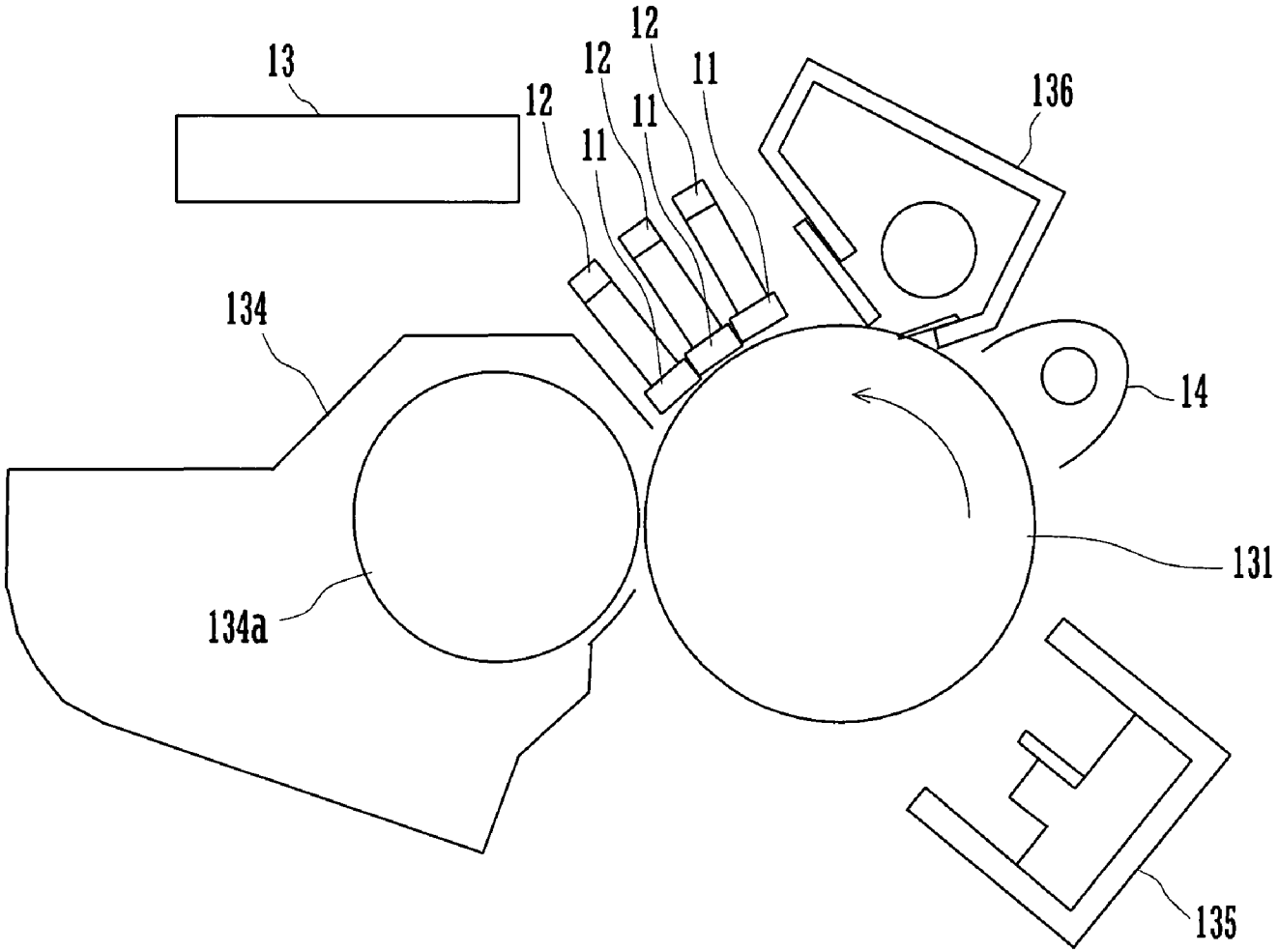
FIG. 2 is a diagram showing the construction of an image forming section of the image forming apparatus of FIG. 1.

The image forming apparatus 100 of the embodiment employs as the light source the LED arrays 12 which can be manufactured to emit illuminating light of a short focal length and a long wavelength with small-diameter LED elements as depicted in FIG. 2. The physical size of the LED elements constituting each LED array 12 should be such that the individual LED elements have illuminating areas corresponding to an intended resolution (e.g., 600 dots per inch, or DPI) that the image forming apparatus 100 can handle. This resolution also determines intervals between the individual LED elements of each LED array 12. As the physical size of the individual LED elements and the element-to-element intervals are determined in this fashion, it is possible to write an electrostatic latent image on the surface of the photosensitive drum 131 with high fidelity, the latent image reproducing individual dots of both "dark areas" and "blank areas" of each original image.

As only necessary regions of the electron generating devices 11 are illuminated by relevant LED elements of the LED arrays 12 based on the image information, the electron generating devices 11 emit electrons from those regions only. The quantity of electrons increases in the gap (approximately 100–200 μm) between the electron generating devices 11 and the surface of the photosensitive drum 131 due to the electron avalanche phenomenon, whereby surface areas of the photosensitive drum 131 corresponding to the illuminated regions of the electron generating devices 11 are charged to a high potential, forming an electrostatic latent image on the outer surface of the photosensitive drum 131.

Provided with at least one LED array 12 including a specific number of LED elements arranged in a linear form all the way along a main scanning direction (the direction of a rotary axis) of the photosensitive drum 131 over a full width thereof, the image forming apparatus 100 can simultaneously write the image information (or produce the latent image) on the photosensitive drum 131 in both the main scanning direction and a sub-scanning direction (which is perpendicular to the main scanning direction) as the photosensitive drum 131 rotates. If multiple LED arrays 12 are arranged parallel to one another as in the illustrated embodiment (FIG. 2), it is possible to achieve such advantageous effects as an increase in the speed of image forming operation, a reduction in the amount of illuminating light emitted from the individual LED elements, and a prolonged service life of the electron generating devices 11.

If the gap between the electron generating devices 11 and the surface of the photosensitive drum 131 is too small, the avalanche phenomenon does not occur on a large scale so that the latent image is not written with sufficient clarity on the surface of the photosensitive drum 131. If the gap between the electron generating devices 11 and the surface of the photosensitive drum 131 is too large (500 μm or larger), on the contrary, electrons are produced in large quantities by an accelerated avalanche phenomenon in the gap. Should this be the case, the electrons scatter sideways beyond target areas determined by the intended resolution on the surface of the photosensitive drum 131, producing a blurred latent image.

Figure 6:
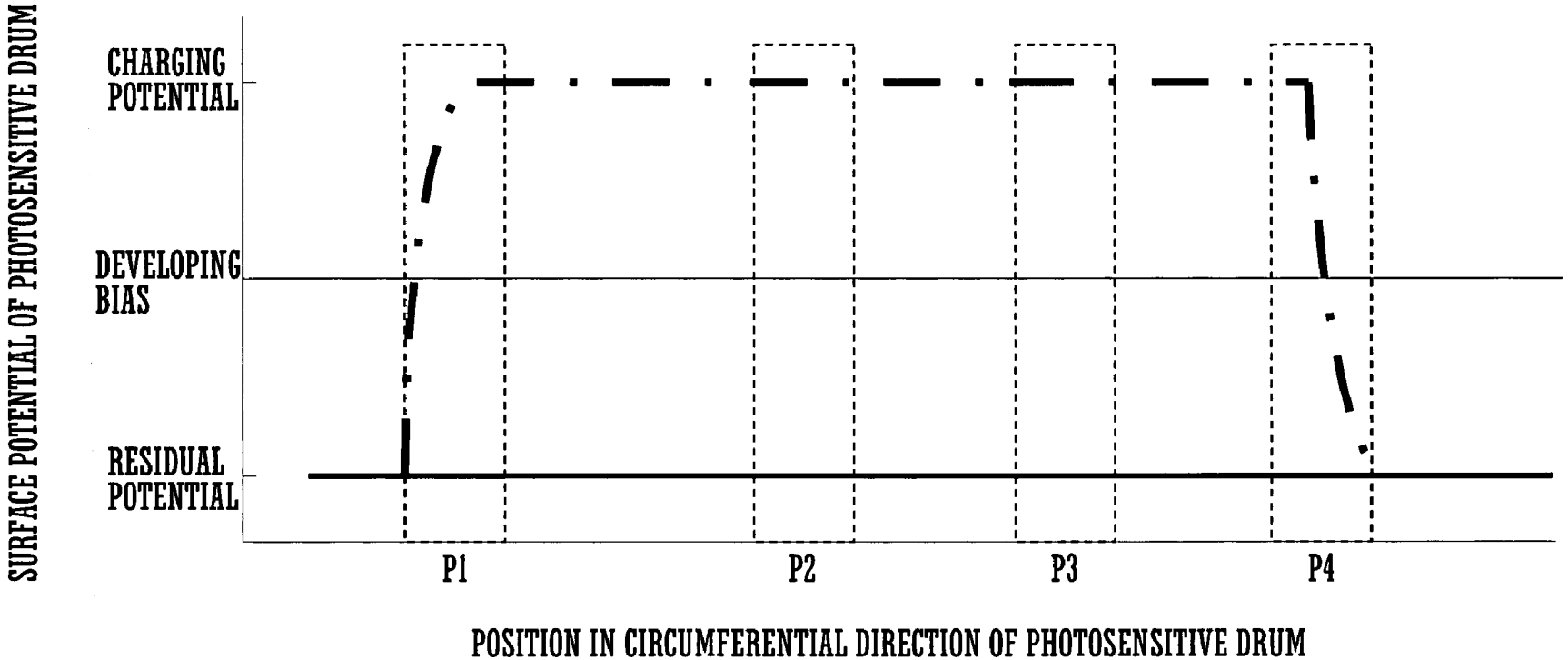
FIG. 6 is a graph showing how an outer surface of a photosensitive drum is charged in a positive image development process.
Figure 7:
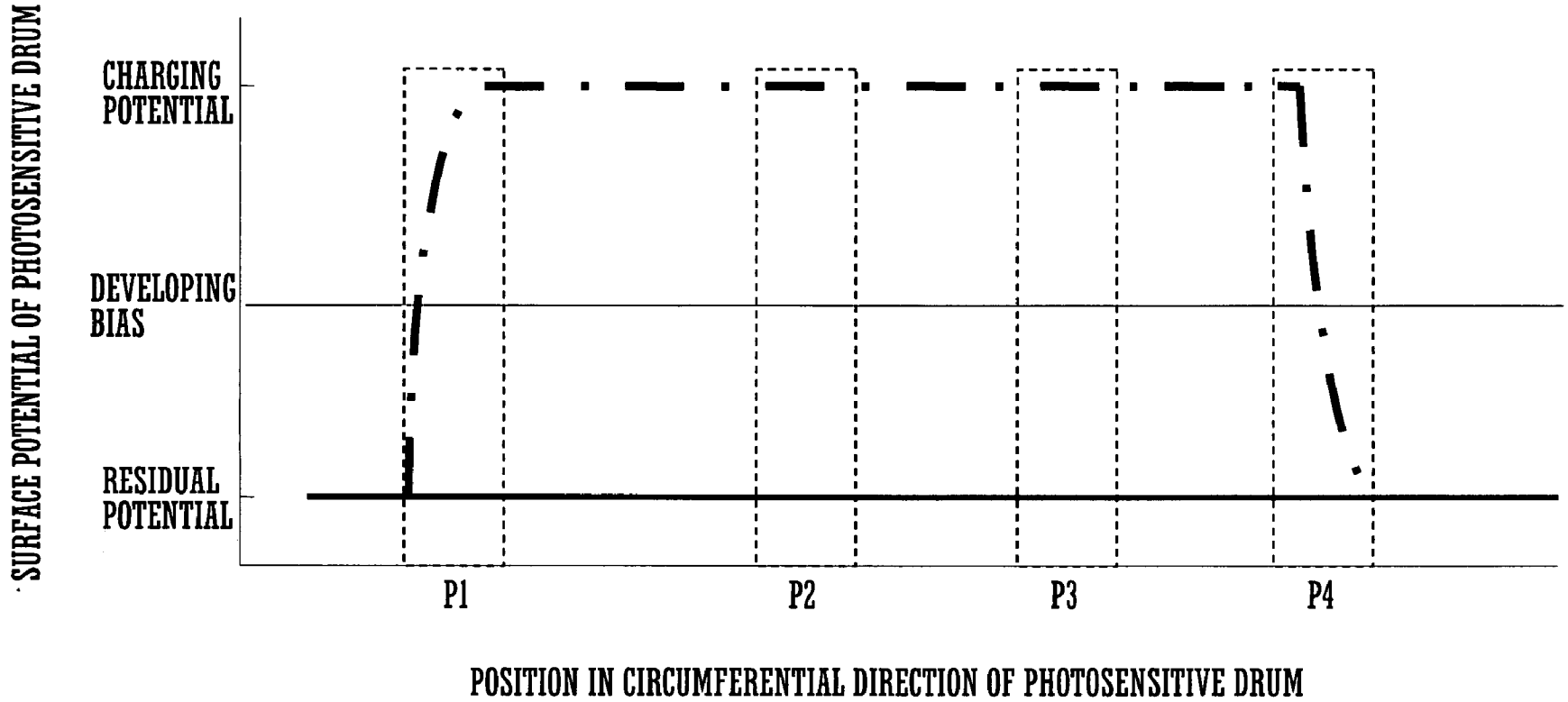
FIG. 7 is a graph showing how the outer surface of the photosensitive drum is charged in a negative image development process.

FIGS. 6 and 7 are graphs showing the relationship between electrons supplied to the surface of the photosensitive drum 131 and the image information. In these Figures, the horizontal axis represents positions along the circumferential direction of the photosensitive drum 131 while the vertical axis represents surface potential of the photosensitive drum 131. P1, P2, P3 and P4 designate locations of surface portions of the photosensitive drum 131 facing the electron generating devices 11, the developing unit 134, the image transfer unit 135 and a discharging unit 14, respectively. Of these Figures, FIG. 6 is for positive image development mode in which the image information is written as a positive latent image and FIG. 7 is for negative image development mode in which the same is written as a negative latent image.

In the positive image development mode of FIG. 6, electrons should be supplied to those surface areas of the photosensitive drum 131 which correspond to "dark areas" of an image to be printed. In the negative image development mode of FIG. 7, on the other hand, electrons should be supplied to those surface areas of the photosensitive drum 131 which correspond to "blank areas" (including white and background areas) of an image to be printed. This is because a developing bias, the surface potential of the photosensitive drum 131 and the polarity of toner charging voltage differ depending on the image developing mode (positive or negative).

Thus, in the positive image developing mode shown in FIG. 6, the driving circuit 13 activates the LED arrays 12 with such timing that LED elements of the LED arrays 12 corresponding to the "dark areas" of the latent image to be formed on the photosensitive drum 131 illuminate when the dark areas of the latent image face the electron generating devices 11. As a result, the surface areas of the photosensitive drum 131 corresponding to the dark areas of the image to be printed are charged to potentials between a developing bias potential and a maximum charging potential according to darkness levels (densities) of the image to be printed.

In FIG. 6, dot-and-dash lines indicate the surface potential of the dark areas of the latent image to be formed on the photosensitive drum 131 while a solid line indicates the surface potential of the blank areas of the latent image to be formed on the photosensitive drum 131.

In the negative image developing mode shown in FIG. 7, the driving circuit 13 activates the LED arrays 12 with such timing that LED elements of the LED arrays 12 corresponding to the "blank areas" of the latent image to be formed on the photosensitive drum 131 illuminate when the blank areas of the latent image face the electron generating devices 11. As a result, the surface areas of the photosensitive drum 131 corresponding to the blank areas of the image to be printed are charged to potentials between a residual potential and a developing bias potential according to darkness levels (densities) of the image to be printed.

In FIG. 7, dot-and-dash lines indicate the surface potential of the blank areas of the latent image to be formed on the photosensitive drum 131 while a solid line indicates the surface potential of the dark areas of the latent image to be formed on the photosensitive drum 131.

The driving circuit 13 drives the individual LED elements of the LED arrays 12 in such a manner that the LED elements emit light with intensities corresponding to densities of individual pixels of the image to be printed. When the multiple electron generating devices 11 and the multiple LED arrays 12 are provided as in the present embodiment, the densities of the individual pixels can also be reproduced by increasing or decreasing the number of illuminated LED elements for each point along the width of the photosensitive drum 131.

In experiments conducted by using electron generating devices 11 employing a photochromic material, LED arrays 12 emitting light having a wavelength of 350 nm produced satisfactory image forming results. Also, experiments conducted by using electron generating devices 11 employing a photoelectric surface in combination with LED arrays 12 emitting light having a wavelength of 150 nm to 350 nm produced satisfactory image forming results.

Figure 8:
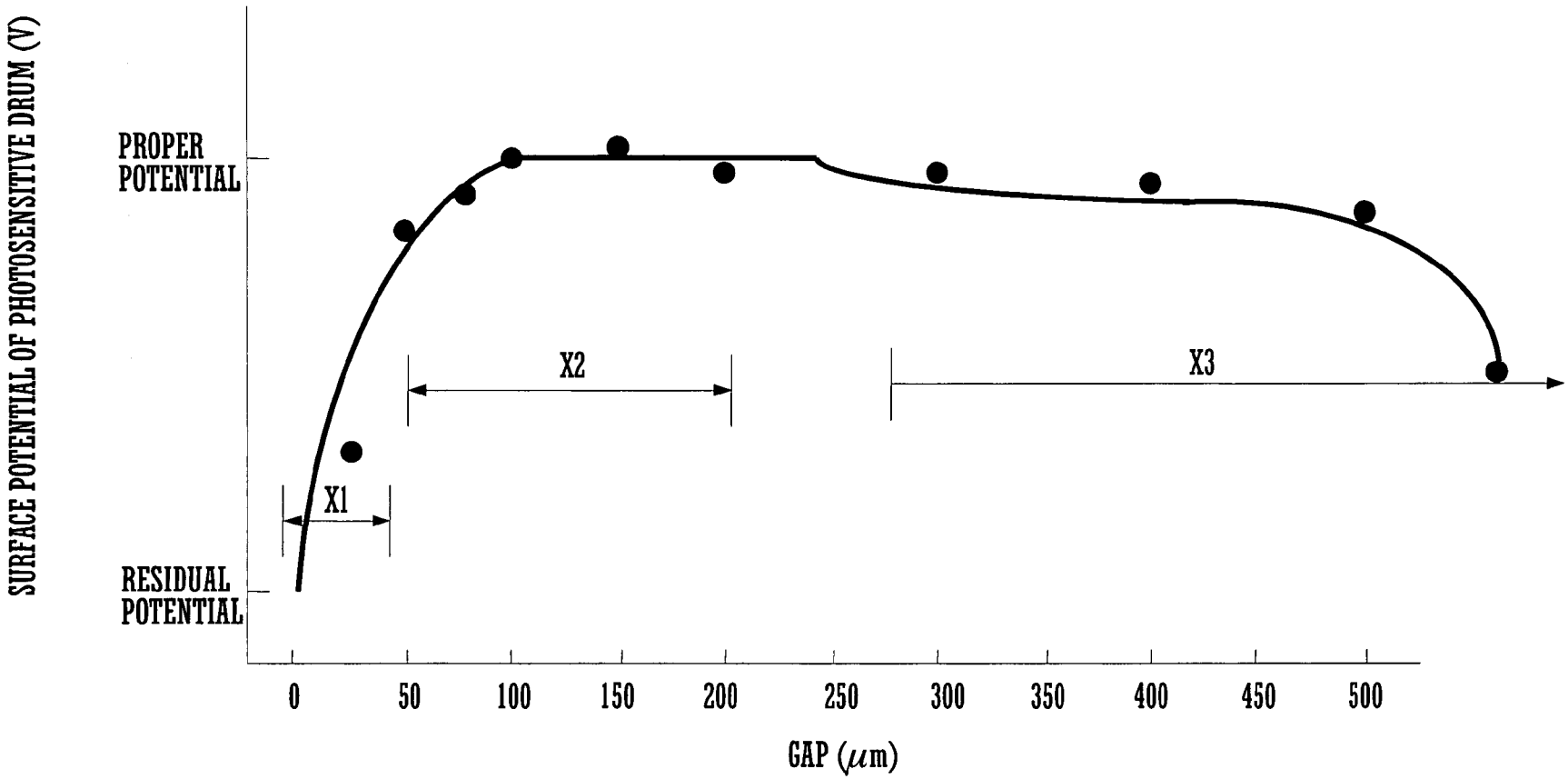
FIG. 8 is a diagram showing the relationship between the distance between electron generating devices and an outer surface of the photosensitive drum and surface potential of the photosensitive drum.

FIG. 8 is a diagram showing the relationship between the distance from the electron generating devices 11 to the outer surface of the photosensitive drum 131 and the surface potential of the photosensitive drum 131. Referring to FIG. 8, designated by X1 is a region in which the number of occurrences of the electron avalanche is small, designated by X2 is a region in which the electron avalanche occurs at proper time intervals and the surface potential of the photosensitive drum 131 increases to a proper level, and designated by X3 is a region in which the electron avalanche occurs so frequently that electrons scatter in unwanted directions.

According to experimental results, the surface of the photosensitive drum 131 could be charged to a potential necessary for performing an image forming operation when the distance between the electron generating devices 11 and the surface of the photosensitive drum 131 was set within a range of 50 μm to 500 μm as depicted in FIG. 8. Preferably, however, the distance between the electron generating devices 11 and the surface of the photosensitive drum 131 should be set within a range of 100 μm to 200 μm in order to charge the surface of the photosensitive drum 131 to a sufficiently high potential needed for performing a satisfactory image forming operation and to prevent scattering of the electrons due to excessive occurrences of the electron avalanche.

When the electron generating devices 11 are to be manufactured by employing a photoelectric surface, the photoelectric surface may be produced by forming a thin film of other conductor than aluminum or a semiconductor material on the silica glass sheet 41 on condition that the thin film has a light transmittance of 50% to 70%.

The electrostatic latent image formed on the surface of the photosensitive drum 131 is converted into a visual toner image according to a distribution of high and low surface potentials on the photosensitive drum 131, the developing bias, as well as the polarity and amount of charges imparted to toner with the aid of toner particles supplied by the developing roller 134*a* of the developing unit 134 in a development stage. In a succeeding image transfer stage, the visual toner image thus produced on the surface of the photosensitive drum 131 is transferred onto a sheet which has been transported to a position between the surface of the photosensitive drum 131 and the image transfer unit 135 as the image transfer unit 135 imparts a voltage opposite to the polarity of the charged toner particles to the sheet. In a fixing stage that follows the image transfer stage, the sheet carrying the toner image which is still loose is passed between the upper and lower heat rollers 137*a*, 137*b* of the fuser unit 137 to apply heat and pressure. In the fuser unit 137, the toner image is fused by the heat and firmly fixed to the sheet by the pressure so that a reproduced original image settles on a surface of the sheet.

Upon completion of the image transfer stage, the photosensitive drum 131 still retains the high and low surface potentials produced by the electrons supplied from the electron generating devices 11 as well as a potential imparted by a transferring electric field applied by the image transfer unit 135. If a succeeding image forming process is performed under this condition, a so-called image memory phenomenon occurs, resulting in a significant degradation of image quality.

To cope with this problem, the image forming apparatus 100 of the embodiment incorporates the aforementioned discharging unit 14. Located face to face with the photosensitive drum 131 between the image transfer unit 135 and the electron generating devices 11, the discharging unit 14 projects discharging light to a surface area of the photosensitive drum 131 which has undergone the image transfer stage to remove any residual surface potential on the surface of the photosensitive drum 131 before that surface area faces the electron generating devices 11. When illuminated by the discharging light, the surface area of the photosensitive drum 131, that is, a photosensitive layer (including electric charge generating and transport sub-layers), is grounded through a conductive base material, such as aluminum, due to the photoconductive effect. Thus, residual electric charges which were present on the surface area of the photosensitive drum 131 are led to the ground and the residual surface potential is removed by the discharging light.

As shown in the foregoing discussion, the light source is constructed of as large a number of LED elements as necessary for achieving the intended resolution in performing the image forming process, the electron generating devices 11 employing the photochromic material or photoelectric surfaces are disposed in illuminating light paths of the respective LED arrays 12 with a specific gap between the electron generating devices 11 and the outer surface of the photosensitive drum 131, and the individual LED elements are activated according to the image information in the image forming apparatus 100 of the present embodiment. This construction of the invention makes it possible to perform the image forming process in a simple way by making charging and exposure operations at the same location. Compared to the earlier-mentioned conventional image forming process in which charging and exposure operations are carried out at separate locations requiring a high-voltage power supply and high power consumption, the image forming process of the invention serves to reduce power consumption and prevent problems arising from an increase in the size of the apparatus and deterioration of the photosensitive drum caused by charging of those portions which need not be charged. In addition to compact design and energy savings, the invention makes it possible to achieve an extended operational life of replacement components and an improvement in image quality.

The invention being thus described, it will be obvious that the same may be varied in many ways. Such variations are not to be regarded as a departure from the spirit and scope of the invention, and all such modifications as would be obvious to one skilled in the art are intended to be included within the scope of the invention.

What is claimed is:

1. An image forming apparatus comprising:

an electron generating device which generates electrons when illuminated, the electron generating device being disposed face to face with a surface of an image carrying member across a specific gap between the electron generating device and the surface of the image carrying member;

an LED array including as large a number of LED elements as necessary for achieving an intended resolution of image information from which an image is to be formed, the LED array being disposed face to face with the surface of the image carrying member with the electron generating device placed therebetween; and a driving circuit for activating the LED array according to the image information.

2. The image forming apparatus according to claim 1, wherein the LED elements are arranged in a linear form along a main scanning direction at intervals corresponding to the resolution of the image information.

3. The image forming apparatus according to claim 1, wherein the gap between the surface of the image carrying member and the electron generating device is set to a range of 50 μm to 500 μm.

4. The image forming apparatus according to claim 1, wherein the gap between the surface of the image carrying member and the electron generating device is set to a range of 100 μm to 200 μm.

5. The image forming apparatus according to claim 1, wherein the electron generating device includes a photochromic material and the LED array emits light having a wavelength of 350 nm.

6. The image forming apparatus according to claim 1, wherein the electron generating device includes a photoelectric surface and the LED array emits light having a wavelength of 150 nm to 350 nm.

7. The image forming apparatus according to claim 1, wherein the electron generating device includes a photoelectric surface made of a thin film formed of one of a conductor material and a semiconductor material having a light transmittance of 50% to 70%.

8. The image forming apparatus according to claim 1, wherein the driving circuit supplies a driving signal corresponding to blank areas of the image formed from the image information.

9. The image forming apparatus according to claim 1, wherein the driving circuit supplies a driving signal corresponding to dark areas of the image formed from the image information.

10. The image forming apparatus according to claim 1 further comprising a discharging unit for projecting discharging light to a surface area of the image carrying member within a period from a point in time when a toner image is transferred to a surface of a recording medium to a point in time when said surface area of the image carrying member faces the electron generating device to eliminate a residual surface potential from said surface area.

11. An apparatus for forming an image from image information comprising:

a material that generates electrons when illuminated, the material being disposed a given distance from a surface of an image carrying member;

an LED array arranged to illuminate said material; and a driving circuit for activating the LED array according to the image information.

12. The apparatus of claim 11 wherein said LED array comprises as large a number of LED elements as necessary for achieving an intended resolution of the image information.

13. The apparatus of claim 12, wherein the LED elements are arranged in a linear form along a main scanning direction at intervals corresponding to the intended resolution of the image information.

14. The apparatus of claim 11, wherein said given distance is about 50 μm to 500 μm.

15. The apparatus of claim 11, wherein said given distance is about 100 μm to 200 μm.

16. The apparatus of claim 11, wherein said material comprises a photochromic material and the LED array emits light having a wavelength of about 350 nm.

17. The apparatus of claim 11, wherein said material comprises a photoelectric surface and the LED array emits light having a wavelength of 150 nm to 350 nm.

18. The apparatus of claim 11, wherein said material comprises a photoelectric surface made of a thin film formed of one of a conductor material and a semiconductor material having a light transmittance of 50% to 70%.

19. The apparatus of claim 11, wherein the driving circuit supplies a driving signal corresponding to blank areas of the image formed from the image information.

20. The apparatus of claim 11, wherein the driving circuit supplies a driving signal corresponding to dark areas of the image formed from the image information.

* * * * *